US006273741B1

(12) United States Patent
Schultz et al.

(10) Patent No.: US 6,273,741 B1
(45) Date of Patent: Aug. 14, 2001

(54) LOCKING CONNECTOR FOR ANTENNA CABLE

(75) Inventors: Gerry N Schultz, Rochester Hills; Tom W. Flemming, Canton; Tommy Yokoyama, Novi; Kyle A Boring, Southfield; Charles J Berra, Troy; P. Jan Boring, Southfield; Makoto Hayash, Novi, all of MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/483,080

(22) Filed: Jan. 14, 2000

(51) Int. Cl.[7] ..... H01R 13/627
(52) U.S. Cl. ..... 439/358; 439/916
(58) Field of Search ..... 439/345, 350–358, 439/489, 916

(56) References Cited

U.S. PATENT DOCUMENTS

| | | | |
|---|---|---|---|
| 1,677,734 | 7/1928 | Smith . | |
| 2,877,437 | 3/1959 | Flanagan . | |
| 4,538,869 | 9/1985 | Richards . | |
| 4,993,967 | 2/1991 | Matsumoto . | |
| 5,090,916 | 2/1992 | Magnier . | |
| 5,176,533 | 1/1993 | Sakurai et al. . | |
| 5,192,225 | 3/1993 | Suzuki . | |
| 5,482,475 | 1/1996 | Kawaguchi . | |
| 5,482,477 | 1/1996 | Michael . | |
| 5,567,179 | 10/1996 | Voltz . | |
| 5,607,325 | 3/1997 | Toma . | |
| 5,620,330 | 4/1997 | Pizon . | |
| 5,718,596 | 2/1998 | Inaba et al. . | |
| 5,775,930 | 7/1998 | Model et al. . | |
| 5,879,180 | 3/1999 | Iwahori et al. . | |
| 5,934,937 | 8/1999 | McCarthy . | |
| 6,024,595 * | 2/2000 | Saba et al. | 439/489 |
| 6,059,598 * | 5/2000 | Yamashita et al. | 439/352 |

* cited by examiner

*Primary Examiner*—Khiem Nguyen
(74) *Attorney, Agent, or Firm*—Mark P. Calcaterra

(57) ABSTRACT

A locking connector for an antenna cable includes a female socket member and a male member axially insertable into the socket member. A catch is formed on a radially outwardly extending collar of the socket member. A flexible latching finger is secured to the male member and has a hook at the free end. The hook is adapted to cam over and lockingly engage the catch when the male member is inserted axially into the socket member. A finger stop limits radially outward flexing of the finger away from the catch to prevent overstressing of the finger.

4 Claims, 2 Drawing Sheets

FIG- 4
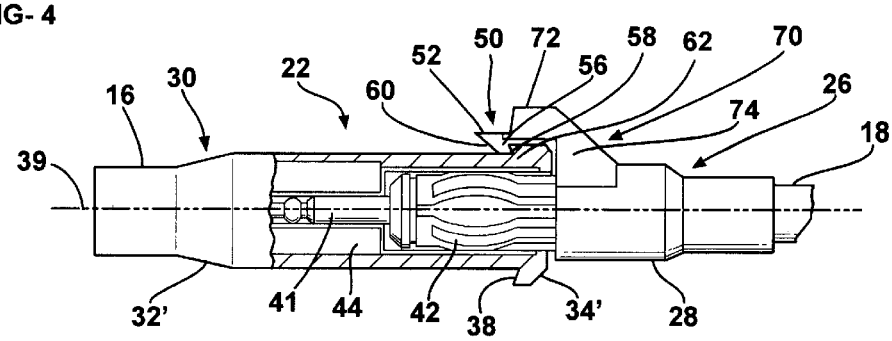
FIG-5
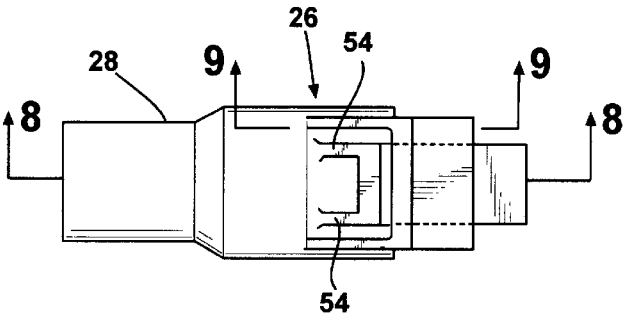
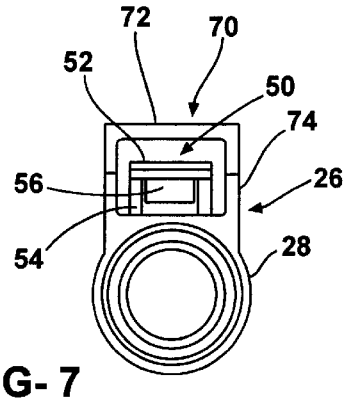
FIG- 7
FIG- 8
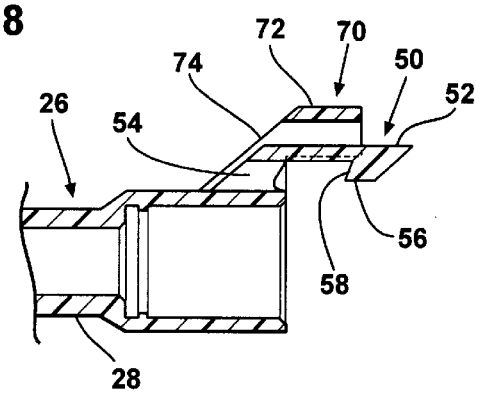
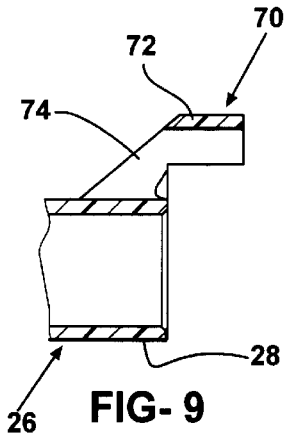
FIG- 9
FIG- 6
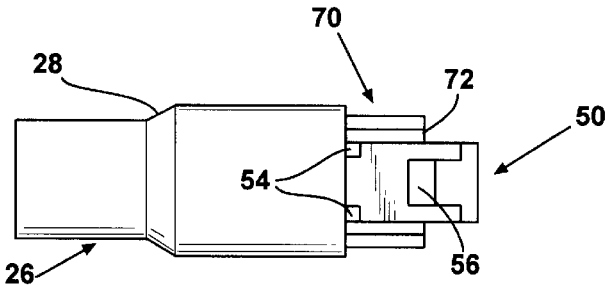

LOCKING CONNECTOR FOR ANTENNA CABLE

This invention relates generally to antenna cables and more particularly to a locking connector for an antenna cable.

BACKGROUND OF THE INVENTION

Coaxial cables are used to transmit signals from an antenna to a radio. Typically, in the case of a car radio, the cable has two parts, one included in an instrument panel harness and the other included in a body harness. Connectors are provided to join the two cable parts together and also to connect one cable part to the antenna. These connectors often include a male member and a socket member secured together with a press fit. However, the two members frequently pull apart, breaking the connection.

SUMMARY OF THE INVENTION

In accordance with the present invention, a locking connector for an antenna cable is provided which includes a male member that is axially insertable into a socket member. A flexible latching finger is secured to one of the members and has a hook on the free end which is adapted to engage a catch on the other member to releasably lock the members together. The hook cams over and lockingly engages the catch when the male member is inserted axially into the socket member. The finger can be flexed away from the catch to retract the hook and release the members. A finger stop is provided to limit the distance the finger can be retracted, thereby preventing overflexing and damaging the finger.

Preferably the catch is formed on a radially outwardly extending collar of the socket member and the finger is secured to the male member.

The finger stop preferably includes a blocker positioned radially outwardly of the finger. The finger stop is connected to the male member by a pair of laterally spaced apart legs straddling the finger.

The finger stop permits sufficient flexing of the finger to release the hook from the catch, but prevents further flexing movement.

One object of this invention is to provide a locking connector for an antenna cable having the foregoing features and capabilities.

Another object is to provide a locking connector for an antenna cable which is composed of a relatively few simple parts, is rugged and durable in use, and is capable of being inexpensively manufactured and easily manipulated.

These and other objects, features and advantages of the invention will become more apparent as the following description proceeds, especially when considered with the accompanying drawings.

BRIEF DESCRIPTION OF THE DRAWINGS

FIG. 4 is a view similar to FIG. 3, with parts broken away and in section, showing the other locking connector which is substantially the same as the locking connector in FIGS. 2 and 3.

FIG. 5 is a fragmentary top view of the body of the male member.

FIG. 6 is a fragmentary bottom view of the body of the male member.

FIG. 7 is an end view of the body of the male member with the electrical contact removed.

FIG. 8 is a sectional view taken on the line 8—8 in FIG. 5.

FIG. 9 is a sectional view taken on the line 9—9 in FIG. 5.

DETAILED DESCRIPTION OF THE PREFERRED EMBODIMENT

Figure 1:
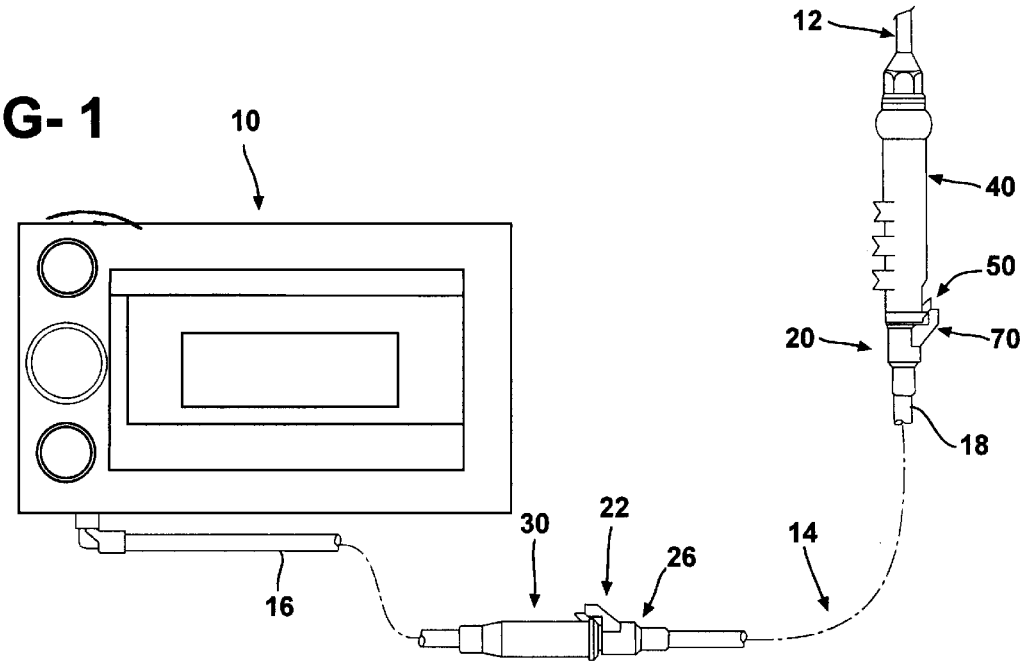
FIG. 1 is a view showing a radio connected to an antenna by a coaxial cable consisting of two cable parts, the cable parts being connected together by a locking connector of this invention and one of the cable parts being connected to the antenna by a similar locking connector.

Referring now more particularly to the drawings, there is shown in FIG. 1 a radio 10, an antenna 12, a coaxial cable 14 consisting of cable parts 16 and 18, a locking connector 20 of this invention connecting the cable parts 16 and 18, and a similar locking connector 22 connecting the cable part 18 to the antenna.

Figure 2:
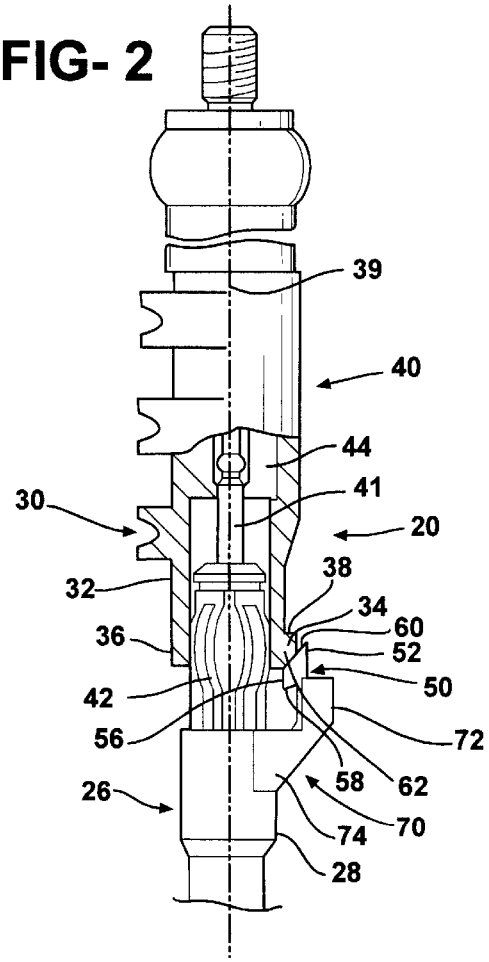
FIG. 2 is an enlarged fragmentary view, with parts broken away and in section, of the locking connector between one of the cable parts and the antenna, prior to full insertion of the male member into the socket member.
Figure 3:
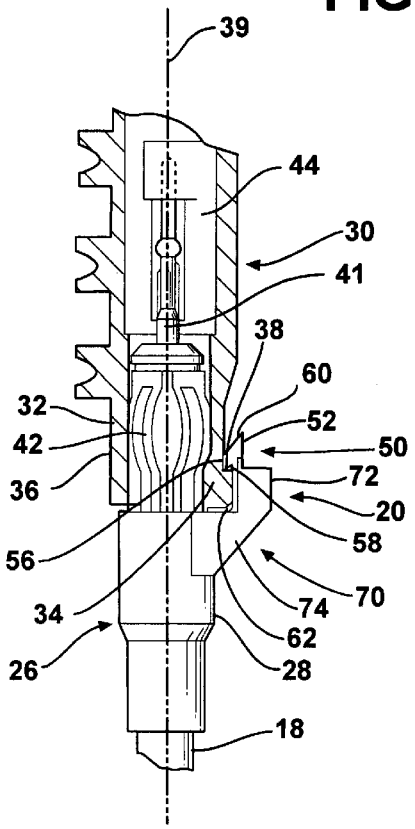
FIG. 3 is a view similar to FIG. 2, but after the male member is fully inserted.

Referring to FIGS. 2 and 3, the locking connector 20 includes a male member 26 which has an elongated, cylindrical, tubular body 28, and a female socket member 30 which has an elongated, cylindrical, tubular body 32. The axially outer end of the body 32 of the socket member has a radially outwardly extending collar 34 which is substantially a continuous annulus, except that it is flattened on one side where indicated at 36 for a purpose which has nothing to do with the present invention. The axially inner arcuate surface 38 of the collar 34 is perpendicular to the longitudinal center line 39 of the body 32. The surface 38 provides a catch for a hook, described more fully hereinafter. The inner end of the body 32 of the socket member is secured to a base 40 of the antenna 12.

One end of the cable part 18 is secured in the inner end of the body 28 of the male member 26 and is electrically connected to a contact 41 which is anchored within and projects axially outwardly beyond the outer end of the body. The contact 41 is surrounded by a series of resilient, radially inwardly compressible spring elements 42 which are adapted to extend into the axially outer end of the body 32 of the socket member when the members 26 and 30 are connected together as in FIG. 3. In this condition, the spring elements 42 are compressed radially inwardly by the body 32 of the socket member to provide a press fit, and the contact 41 engages a contact 44 in the body of the socket member to provide an electrical connection between the cable part 18 and the antenna 12.

The body 28 of the male member 26 is made of a suitable material such as ABS. The body 32 of the socket member 30 is made of suitable material such as polypropylene.

The male member has a flexible latching finger 50 which is preferably integral and of one piece with the body 28. The finger 50 at its free end has an end portion 52 which is in a plane spaced radially outwardly from the body 28 and is parallel to the longitudinal center line 39 of the body.

The finger also includes a pair of laterally spaced apart, parallel legs 54 which extend from opposite side edges of the end portion 52 and are integrally connected to the body 28. The legs slant axially and radially outwardly from the body to the end portion 52.

The end portion 52 at the free end of the finger 50 has a hook 56 on its radially inner side. The hook 56 has a radially inwardly extending surface 58 which is adapted to engage the inner surface 38 of the collar, the surface 38 serving as a catch to lock the two connector members together. The hook has a camming surface 60 which flares radially and axially outwardly from the male member to engage a similarly inclined camming surface 62 on the collar 34 of the socket member. The camming surface 62 is inclined at the same angle as the camming surface 60 so that when the male member is inserted into the socket member the hook 56 cams over the collar 34 and engages behind the collar as shown in FIG. 3, locking the two members 26 and 30 together. The finger 50 is sufficiently flexible to permit the hook 56 to cam over the collar 34 and also to permit the hook 56 to be manually retracted far enough to clear the collar when it is desired to release the locking connection.

The male member 26 has a finger stop 70 which preferably is integral and of one piece with the body 28. The finger stop 70 includes a finger blocker 72 which is spaced radially outwardly from and parallel to the end portion 52 of the finger 50. The finger stop 70 also includes a pair of laterally spaced apart parallel legs 74 which extend from opposite side edges of the blocker 72 and are integrally connected to the body 28. The legs 74 are spaced laterally outwardly from and straddle the legs 52 of the finger 50. The blocker 72 of the finger stop 70 is spaced radially outwardly of the end portion 52 of the finger 50 a sufficient distance to permit the finger to flex outwardly and the hook 56 to cam over the collar 34 when the male member 26 is inserted into the socket member 30, and also to permit the hook 56 to be manually retracted far enough to clear the collar when it is desired to release the locking connection. The blocker 72 prevents retraction of the finger farther than necessary to either lockingly engage or disengage the connection between the male and socket members. Excessive flexing of the finger could overstress and damage or even break the finger.

The locking connector 22 is substantially the same as the locking connector 20 with similar reference numerals for the various parts thereof, but with the exception that the collar 34' of the body 32 of the socket member 30 of the connector 22 is a continuous annulus and does not have a flattened side as does the collar of the body 32 of the socket member 30 of the connector 20 previously described. The body 28 of the male member 26 in FIG. 5 receives an end of the cable part 18 which is electrically connected to a contact 41. The body 32 of the socket member 30 in FIG. 5 receives an end of the cable part 16 which is electrically connected to a contact 44 in the body 32 which in turn engages the contact 41 of the male member when the connector members are joined together as in FIG. 5.

What is claimed is:

1. A locking connector for an antenna cable comprising, a female socket member, a male member axially insertable into said socket member, first means for releasably locking said members together with said male member inserted in said female socket member, said first means comprising a catch on one of said members, a flexible latching finger on the other of said members having a free end provided with hook, said hook being adapted to cam over and lockingly engage said catch when said male member is inserted axially into said socket member, said finger being adapted to be flexed away from said catch to retract said hook away from said catch and release said members, and second means for limiting the radially outward flexing of said finger away from said catch to prevent overstressing of said finger, wherein said second means for limiting the radially outward flexing of said finger comprises a finger stop, said finger stop comprises a finger blocker radially outwardly of said finger, said finger stop having laterally spaced apart legs extending from said blocker and straddling said finger and integrally connected to said other of said members.

2. A locking connector for an antenna cable comprising, a female socket member, a male member axially insertable into said socket member, first means for releasably locking said members together with said male member inserted in said female socket member, said first means comprising a catch on said socket member, said catch being formed on a radially outwardly extending collar on said socket member, a flexible latching finger having a pair of laterally spaced apart first legs integrally secured to said male member, said latching finger having a free end provided with a hook, said hook being adapted to cam over and lockingly engage said catch when said male member is inserted axially into said socket member, said finger being adapted to be flexed radially outwardly away from said catch to retract said hook away from said catch and release said members, and second means limiting the radially outward flexing of said finger away from said catch to prevent overstressing of said finger, said second means comprising a finger stop including a finger blocker radially outwardly of said finger, said finger stop having a pair of laterally spaced apart second legs straddling said finger, said second legs extending from said blocker and integrally connected to said male member.

3. A locking connector as defined in claim 2, further including means connecting one of said members to the cable and means connecting the other of said members to an antenna.

4. A locking connector as defined in claim 2, wherein the cable includes first and second cable parts, and further including means connecting one of said members to one of said cable parts and means connecting the other of said members to the other of said cable parts.

* * * * *